United States Patent [19]

Tsubota

[11] 4,238,946

[45] Dec. 16, 1980

[54] METHOD FOR ROLLING METAL PLATE

[75] Inventor: Kazuya Tsubota, Okayama, Japan

[73] Assignee: Kawasaki Steel Corporation, Kobe, Japan

[21] Appl. No.: 68,436

[22] Filed: Aug. 21, 1979

Related U.S. Application Data

[63] Continuation-in-part of Ser. No. 891,188, Mar. 29, 1978, abandoned.

[30] Foreign Application Priority Data

Apr. 4, 1977 [JP] Japan ..... 52-38306

[51] Int. Cl.[3] ..... B21B 1/00

[52] U.S. Cl. ..... 72/199; 72/366

[58] Field of Search ..... 72/199, 226, 227, 234, 72/365, 366, 203, 240; 29/527.7

[56] References Cited

FOREIGN PATENT DOCUMENTS

| | | | |
|---|---|---|---|
| 51-25823 | 8/1976 | Japan | 72/366 |
| 52-36503 | 9/1977 | Japan | 72/366 |
| 1063373 | 3/1967 | United Kingdom | 72/366 |

*Primary Examiner*—Milton S. Mehr

*Attorney, Agent, or Firm*—Koda and Androlia

[57] ABSTRACT

A method for rolling metal plate to form a thinner metal plate having a desired thickness including the steps of rolling metal plate at a predetermined board side rolling ratio to form a first metal plate having edge and crop portions, sizing the first metal plate such that a central portion of the first plate in a section parallel to a longitudinal direction thereof is greater in thickness than that of the end portions thereof if the edges of the first metal plate are spool shaped or sizing the first metal plate such that the central portion of the first plate in a section parallel to a longitudinal direction thereof is less in thickness than that of the end portions thereof if the edges of the first plate are barrel shaped, rolling the first plate to form a second plate of a predetermined thickness, sizing the second plate such that the central portion of the second plate in a section normal to a longitudinal direction thereof is thinner than the end portions thereof if the crop portions of the second plate bulge outwardly or sizing the second plate such that the central portion of the second plate in a section normal to a longitudinal direction thereof is thicker than the end portions thereof if the crop portions of the second plate are sunken and rolling the second plate to form said thinner metal plate.

14 Claims, 11 Drawing Figures

METHOD FOR ROLLING METAL PLATE

This is a continuation-in-part of application Ser. No. 891,188 filed Mar. 29, 1978, now abandoned.

BACKGROUND OF THE INVENTION

1. Field of the Invention

The present invention relates to methods for rolling metal plate and more particularly to rolling method including multiple rolling steps.

2. Prior Art

In general, in the rolling work of metal plates, slabs manufactured by continuous casting equipment or a slabbing mill are rolled to a predetermined value of thickness by a thick sheet metal mill (a roughing mill and a finishing mill), and thereafter, cut into the dimensions of product by a shearing device or a gas cutter, to thereby obtain a product.

Detailed description will hereunder be given of a conventional rolling method. As shown in FIG. 1, first a slab 1 drawn out of a reheating furnace has its uneven section made even and uniform to obtain the standard thickness according to the broadening calculation by a rolling process which is the so-called sizing pass, and is rolled in the longitudinal direction through one pass or two to three passes, thus obtaining a condition indicated by reference numeral 2. Next, the rolled metal 2 is rotated through 90° in a horizontal plane to obtain a condition indicated by reference numeral 3, sent to a rolling process which is the so-called broad side pass, and rolled to a given value in the width-wise direction, thus obtaining a condition indicated by reference numeral 4. Then, the rolled metal 4 is rotated through 90° again in a horizontal plane to be restored to the original condition, i.e., a condition 5 where the longitudinal direction of said rolled metal is in parallel to the direction of the pass, suitably decreased in thickness in the longitudinal direction thereof, and thereafter sent to the so-called shape control pass which is the final rolling process by a finishing mill to thus obtaining a finished rolled metal 6.

Heretofore, the shape of the rolled metal 6 rolled to a given value of thickness by the shape control pass has been the ones shown in FIG. 2 or 3. Namely, as shown in FIG. 2, for example, the rolled metal 6 is generally spool-shaped, and more specifically the centers of the edge portions 6A is less in width than the opposite end portions. Furthermore, crop portions 6B are formed so as to bulge outwardly in the longitudinal direction of the rolled metal 6. Or, as shown in FIG. 3, the rolled metal 6 is generally barrel-shaped, and more specifically, the centers of edge portions 6A are larger in width than the opposite end portions. Additionally, the centers of the crop portions 6B are sunken inwardly in the longitudinal direction of the rolled metal 6.

Accordingly, to commercialize the rolled metal, it has been necessary that the edge portions 6A and crop portions 6B be cut off of the rolled metal 6 to obtain the contours shown by two-dotted chain lines in FIGS. 2 and 3. Thus, there has been presented such a disadvantage that there are many cut-off portions, thus lowering the yield.

The present invention is intended to eliminate the above disadvantage of the prior art.

SUMMARY OF THE INVENTION

Accordingly, it is a general object of the present invention to provide a method for rolling thick sheet metal plate wherein the shape of the rolled metal rolled by the shape control pass is substantially rectangular.

It is another object of the present invention to provide a method for rolling thick sheet metal plate in which the yield is increased.

In keeping with the principles of the present invention, the objects are accomplished by a unique method for rolling metal plate to form a thinner metal plate having a desired thickness including the steps of rolling the metal plate at a predetermined broadside rolling ratio to form a first metal plate having edge and crop portions, sizing the first metal plate such that a central portion of the first plate in a section parallel to a longitudinal direction thereof is greater in thickness than that of the end portions thereof if the edges of the first metal plate are spool shaped or sizing the first metal plate such that the central portion of the first plate in a section parallel to a longitudinal direction thereof is less in thickness than that of the end portions thereof if the edges of the first plate are barrel shaped, rolling the first plate to form a second plate of predetermined thickness, sizing the second plate such that the central portion of the second plate in a section normal to a longitudinal direction thereof is thinner than the end portions thereof if the crop portions of the second plate bulge outwardly or sizing the second plate such that the central portion of the second plate in a section normal to a longitudinal direction thereof is thicker than the end portions thereof if the crop portions of the second plate are sunken and rolling the second plate to form said thinner metal plate.

BRIEF DESCRIPTION OF THE DRAWINGS

The above mentioned features and objects of the present invention will become more apparent with reference to the following description taken in conjunction with the accompanying drawings in which like elements are given like reference numerals and in which.

DETAILED DESCRIPTION OF THE INVENTION

It has been found through experiments conducted by the present inventor that the shape of edge portions of the rolled metal upon the completion of the shape control pass which is the final rolling process was considerably influenced by the broadside rolling ratio Hp, wherein Hp is given by:

$$Hp = \frac{\text{Width of rolled metal upon the completion of final rolling}}{\text{Width of slab before rolling}}$$

Figure 1:
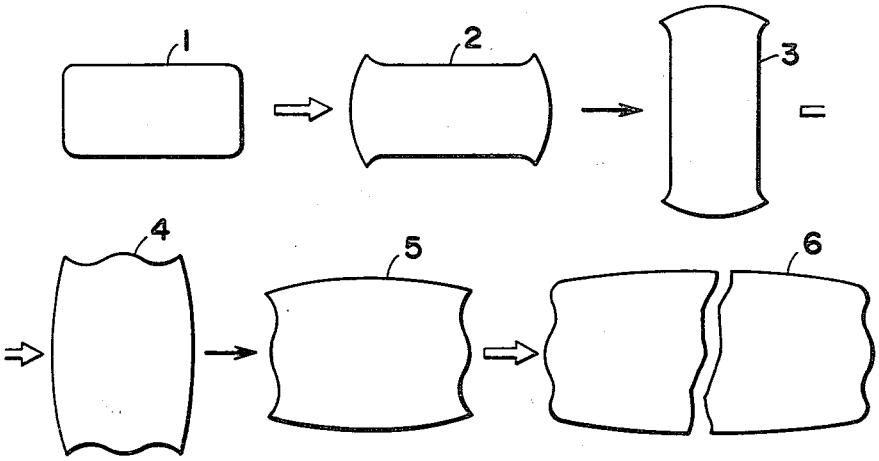
FIG. 1 PRIOR ART
FIG. 1 is an explanatory view successively showing the outline of a conventional rolling processes for the thick sheet metal in common use.
Figure 2:
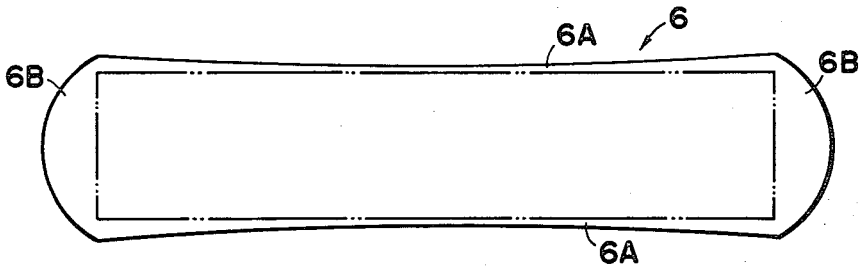
FIG. 2 PRIOR ART
FIGS. 2 and 3 are plan views showing the contours of the rolled metals upon the completion of the final rolling process in the prior art, respectively.
Figure 3:
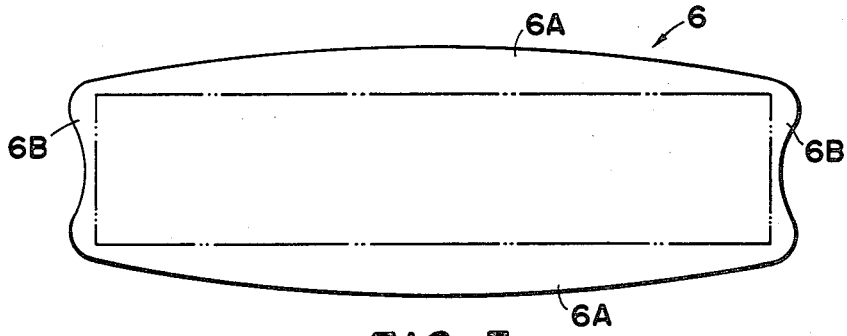
FIG. 3 PRIOR ART
Figure 4:
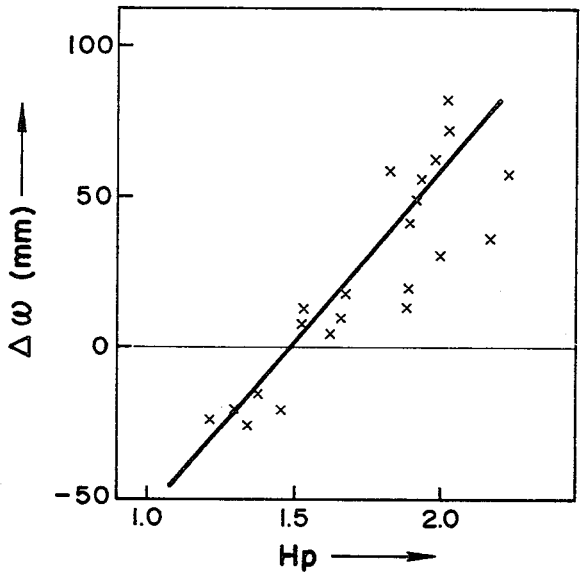
FIG. 4 is an explanatory view showing the relationship between the broadside rolling ratio and the value of change in width.

The relationship between the broadside rolling ratio Hp and the value of change in width $\Delta\omega$ indicating the shape of edge portion is shown in FIG. 4. Herein, the value of change in width is given by:

$$\Delta\omega = M - (T+B)/2$$

where B is the dimension in width at the central portion of the rolled metal, T and M are the dimensions in width at the end bitten into by the roll and by the end bitten out of the pressure roll. It is indicated that, when $\Delta\omega$ is less than 0, the edge portions are spool-shaped as shown in FIG. 2, whereas, when $\Delta\omega$ is larger than 0, the edge portions are barrel-shaped as shown in FIG. 3. Accordingly, it is understood that, from FIG. 4, when $\Delta\omega$ equals to 0, the broadside rolling ratio is about 1.5 and that when Hp is less than about 1.5, the shape of the edge portions are spool-shaped. Whereas, when Hp is larger than about 1.5, the shape of the edge portions are barrel-shaped. Additionally, the shape of said edge portions cannot be corrected even by the rolling work performed in the shape control pass which is the final rolling process, and therefore, should be corrected before the shape control pass.

Furthermore, it was found that the average length of the crop portions of rolled metal has a relation to the rolling ratio and broadside crop portions, and further, that the shape of the crop portions are influenced by the broadside rolling ratio.

The average length Lcrop of the crop portions of rolled metal is given by:

$$Lcrop = 80(Lp/Hp) + 160$$

where Lp is the rolling ratio, and Lp is as follows:

$$Lp = \frac{\text{Length of rolled metal upon completion of final rolling}}{\text{Length of slab before rolling}}$$

Figure 5:
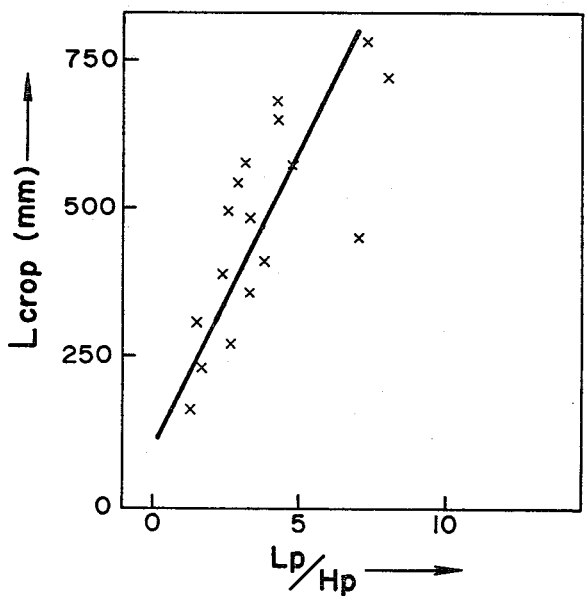
FIG. 5 is an explanatory view showing the relationship between Lp/Hp and the average length of the crop portions.

Further, Lp/Hp and the relationship between Lp/Hp and the average length of the crop portions of rolled metal is shown in FIG. 5.

According to the experimental data of the present inventor, when the broadside rolling ratio Hp is less than about 1.8, the shape of the crop portions are such that the centers in the widthwise direction of the crop portions are outwardly bulged in the longitudinal direction of the rolled metal, respectively, as shown in FIG. 2 above; and that when Hp is larger than about 1.8, the shape of the crop portions are such that the centers in the widthwise direction of the crop portions are inwardly sunken in the longitudinal direction of the rolled metal, respectively, as shown in FIG. 3.

The dimensions of the rolled metal plate is usually known beforehand from the production schedule and the dimensions of the slab before rolling is also known, and hence, the broadside rolling ratio Hp and the average length of the crop, Lcrop, can be determined. Therefore, the shape of the rolled metal upon the completion of the shape control pass which is the last rolling process, i.e., the shape of the edge portion and crop portion, can be predicted.

Accordingly, with respect to the edge portions, the rolling mill is controlled at the final time of sizing pass to thereby form the blank or rolled metal 2, i.e., the slab, into the following shapes.

Figure 6:
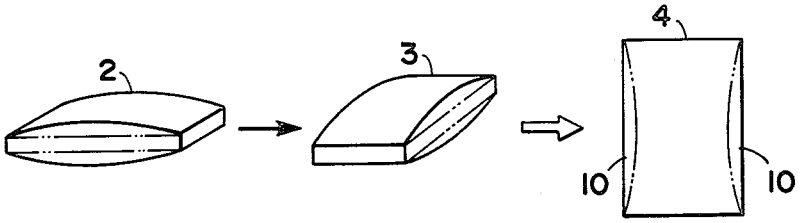
FIGS. 6 and 7 are explanatory views successively showing the change in contour of the edge portions of the rolled metal according to the present invention.

In particular, when the broadside rolling ratio Hp is less than about 1.5, the value of change in width $\Delta\omega$ becomes a negative value as shown in FIG. 4, and the shape of the rolled metal upon the completion of rolling becomes spool-shaped, as shown in FIG. 2, though differences may occur depending upon the condition of roll broadside rolling ratio Hp crown. For this, the rolled metal 2 in the process of the present invention is formed into a barrel shape in section parallel to the longitudinal direction thereof upon the completion of sizing pass, as shown in FIG. 6. More specifically, the rolled metal 2 is sized such that the center becomes larger in thickness than that of opposite end portions. After sized as above, the rolled metal 2 is rotated through 90° in a horizontal plane to obtain a condition indicated by reference numeral 3 and subjected to the broadside pass. Accordingly, the rolled metal 2 will be provided with substantially rectilinear edge portions. Here, if thickness of the rolled metal 2 is made uniform as indicated by the two-dotted chain lines, then the rolled metal 4 after the broadside pass will have spool-shaped edge portions as indicated by the two-dotted chain lines. However, allowances 10 for said difference in thickness are adapted to correct the spool-shape, thereby forming the edge portions into straight lines.

Figure 7:
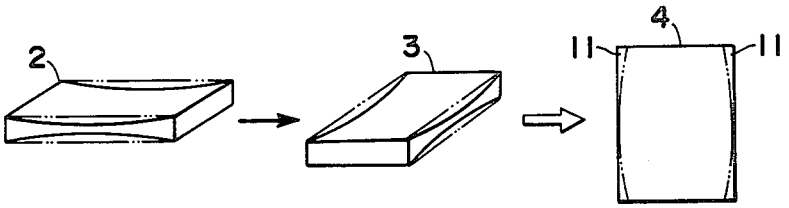

Additionally, when the broadside rolling ratio Hp is larger than about 1.5, the value of change in width $\Delta\omega$ becomes a positive value as shown in FIG. 4 and the shape upon the completion of rolling becomes barrel shaped as shown in FIG. 3. For this, as shown in FIG. 7, the rolled metal 2 may be formed into a spool shape in section parallel to the longitudinal direction thereof, i.e., in a manner to make thickness of the central portion less than that of the opposite end portions, upon the completion of sizing pass. Here, if the rolled metal having uniform thickness as shown in two-dotted chain lines is sent to the broadside pass, then the rolled metal 4 will have barrel-shaped edge portions. However, the opposite end portions are larger in thickness than the central portion, and an allowance 11 for the difference in thickness is adapted to correct the barrel-shaped edge portions, thereby forming the edge portions into straight lines.

Next, with respect to the crop positions, the broadside rolling ratio Hp and rolling ratio Lp are calculated from the dimensions of a plate, thus predicting the shape and the average length of the crop portions. The plate mill is controlled based on the predicted shape of the crop portions at the final time of the broadside pass to thereby form the rolled metal 4 into the following shapes.

Figure 8:
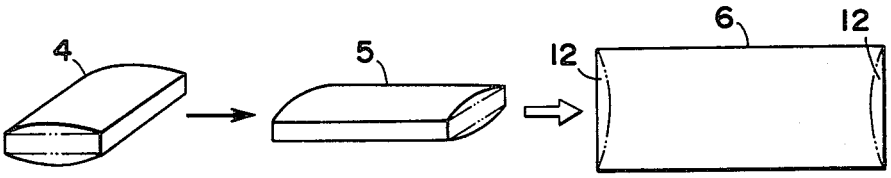
FIGS. 8 and 9 are explanatory views successively showing the change in contour of the crop portions of the rolled metal according to the present invention.

Firstly, if Hp is larger than about 1.8, the rolled metal 4 is formed into a barrel shape in section normal to the longitudinal direction thereof, i.e., in a manner that the central portion is larger in thickness than the opposite end portion, as shown in FIG. 8.

The rolled metal 4 is rotated through 90° in a horizontal plane to obtain a condition indicated by reference numeral 5 and subjected to the shape control pass and then the rolled metal 6 is corrected whereby the crop portions thereof will have substantially straight lines. If the rolled metal 4 has uniform thickness upon the completion of the shape control pass as indicated by two-dotted chain lines in FIG. 8, then the crop portions of the rolled metal 6 will be formed into spool shapes upon the completion of the shape control pass. However, an allowance 12 for the difference in thickness in a section normal to said longitudinal direction is adapted to correct the spool shape, thus, forming the crop portions into straight lines.

Figure 9:
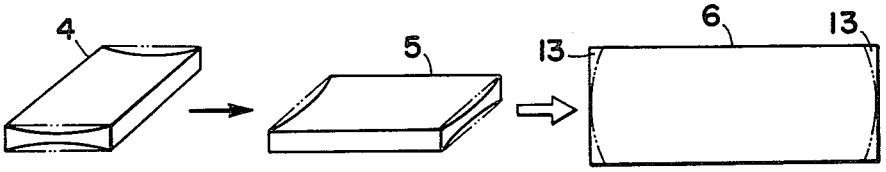

Additionally, if Hp is less than about 1.8, it suffices to form the rolled metal 4 into a spool shape in a section normal to the longitudinal direction thereof, i.e., in a manner that the central portion is less in thickness than the opposite end portions, as shown in FIG. 9. The rolled metal 4 is formed as above, whereby an allowance 13 for the difference in said thickness is adapted to correct the tendency of the crop portions of the rolled metal 6 to become barrel-shaped as indicated by two-dotted chain lines upon the completion of the shape control pass thereby forming the crop portions into substantially straight lines.

To sum up, although there are slight differences depending on the conditions how crowns are given to the rolling rolls and the like, it is preferable that:

(1) When Hp is less than about 1.5;

A section of the rolled metal parallel to the longitudinal direction upon the completion of sizing pass is formed into a barrel shape (see FIG. 6), and a section of the rolled metal normal to the longitudinal direction when the rolled metal is rotated through 90 in a horizontal plane after the completion of the broadside pass is formed into a spool shape (See FIG. 9), (2) When Hp is larger than about 1.5 and being less than about 1.8;

A section of the rolled metal parallel to the longitudinal direction upon the completion of sizing pass is formed into a spool shape (See FIG. 7), and a section of the rolled metal normal to the longitudinal direction when the rolled metal is rotated through 90 in a horizontal plane after the completion of the broadside pass is formed into a spool shape (See FIG. 9);

(3) When Hp is larger than about 1.8;

A section of the rolled metal parallel to the longitudinal direction upon the completion of sizing pass is formed into a spool shape (See FIG. 7), and a section of the rolled metal normal to the longitudinal direction when the rolled metal is rotated through 90 in a horizontal plane after the completion of the broadside pass is formed into a barrel type (See FIG. 8).

Consequently, the work roll gap at the time broadside pass is adjusted such that the rolled metal 4 shown at the extreme right in FIG. 6 is always formed into the shape shown at the extreme left in FIG. 9 because Hp is larger than about 1.5 in FIG. 6, and the rolled metal 4 shown at the extreme right in FIG. 7 is formed into the shape shown at the extreme left in FIG. 9 when Hp is larger than about 1.5 and is less than about 1.8, and is formed into the shape shown at the extreme left in FIG. 8 when Hp is larger than about 1.8.

In the cases as described above, the section of the rolled metal parallel to the longitudinal direction upon the completion of sizing pass hardly affects the shapes of crop portions upon the completion of broadside pass, and the section of the rolled metal normal to the longitudinal direction upon the completion of broadside pass hardly affects the shapes of edge portion upon the completion of shape control pass.

Next, description will be given of construction and action of the rolling apparatus for working the present invention. As the rolling apparatus described above, i.e. the rolling apparatus in which the work roll gap is automatically adjusted during rolling process, there have heretofore been used the well-known AGC (Automatic Gauge Control) or similar equipment, although there are differences in the object of use and method of operation from the rolling apparatus described above.

Figure 10:
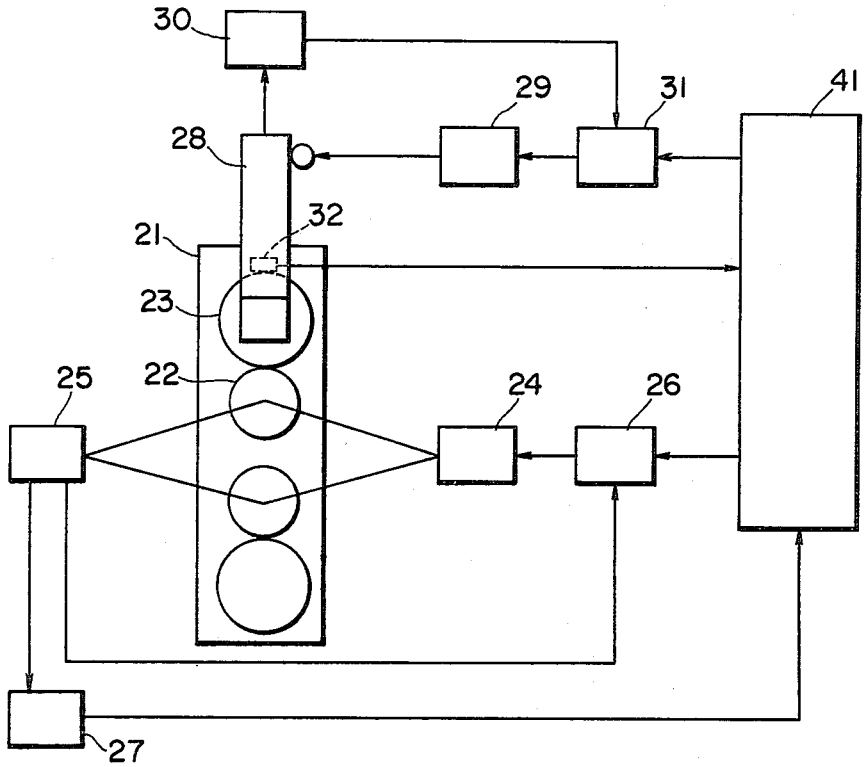
FIG. 10 is a block diagram showing the rolling apparatus embodying the present invention.

FIG. 10 is a block diagram showing the rolling mill for working the present invention. In FIG. 10, the rolling apparatus comprises a rolling mill 21 and a computer 41. The rolling mill 21 comprises a pair of work rolls 22 and a pair of backup rolls 23. Connected to the pair of work rolls 22 are a main rotor 24 and a roll speed sensor 25 for sensing the number of revolutions. Signals from said roll speed sensor 25 are fed back to the main motor 24 via a control device of roll speed 26 so that the number of revolutions of the work rolls 22 can be maintained at a predetermined value. Additionally, signals from the roll speed sensor 25 are adapted to be fed to the computer 41 via a pulse generator 27.

A feed screw mechanism 28 for vertically moving the backup rolls 23 to adjust the gap formed between the work rolls 22 is provided on the backup rolls 23 disposed upwardly of the rolling mill 21, and is connected to a screw driving motor 28 and a screw position sensor 30. Signals from said screw position sensor 30 are fed to the screw driving motor 28 via a control device of screw position 31 so that the gap formed between the work rolls 22 can be controlled to be set at a predetermined value.

A load cell 32 is provided on the backup roll 23, which can detect the start of bite-in of the rolled metal to the gap formed between the work rolls 22 and the bite-out therefrom. Signals from said load cell 32 are fed to the computer 41. Connected to said computer 41 are said control device of roll speed 26 and control device of screw position 31, so that commands can be given to those control devices from the computer 41.

With the arrangement described above, data on the rolling conditions such as thickness, width, length and the like of the rolled metal before the rolling and thickness, width, length and the like after the rolling are fed to the computer 41 to thereby estimate the final shape of the rolled metal. The computer 41, having determined the rolling conditions based on this estimate, sends signals to the control device of roll speed 26 and control device of screw position 31 to drive the main motor 24 and screw driving motor 28, rotate the work rolls 22 at a predetermined speed and set the gap formed between the work rolls 22 at a predetermined value. When the rolled metal is bitten into the gap between the work rolls 22 under the above conditions, this bite-in is sensed by the load cell 32, the screw driving motor 29 is driven in accordance with the conditions determined by the computer 41, to thereby adjust the gap formed between the work rolls 22. As the rolling proceeds, the number of revolutions of the work rolls 22 is sensed by the roll speed sensor 25 to measure the feed value of the rolled metal, the sensing signal is converted into a pulse signal by a pulse generator to be fed to the computer 41, then, the computer 41, being based on said pulse signal, feeds a signal to the control device of screw position 31 to adjust the gap formed between the work rolls 22 via the screw driving motor 29 and the feed screw mechanism 28, to thereby control the section of the rolled metal over the total length in the feeding direction to the predetermined shape.

Description will hereunder be given of one example of the application of the present invention.

A slab having thickness of 220 mm, width of 1,575 mm and length of 3,000 mm is caused to pass through a sizing pass, broadside pass and shape control pass to obtain a metal plate having thickness of 15 mm, width of 3,200 mm and length of 21,000 mm. In addition, flat rolls are used.

In this case, the broadside rolling ratio is given by:

$$Hp=3{,}200/1{,}575=2$$

Therefore, Hp is larger than 1.5, and the value of change in width $\Delta\omega$ is about 60 mm as calculated from FIG. 4, the value indicating the rate of change in width of product of about 1.90 percent. Hence to correct the edges, it suffices to roll and form the rolled metal upon the completion of the sizing pass in a manner that the central portion in section parallel with the longitudinal direction thereof is less in thickness than the opposite end portions by a value of thickness corresponding to the rate of increase in thickness 1.90 percent (totally about 4.2 ($=220\times0.019$)mm, both surfaces being put together) as indicated by reference numeral 2 in FIG. 7 above.

Additionally, the rolling ratio, in this case, is given by:

$$Lp=21{,}000/3{,}000=7$$

Therefore, $$Lp/Hp=7/2=3.5$$

The average length of crop portions Lcrop is about 400 mm as calculated from FIG. 5. Additionally, in this case, Hp is larger than 1.8, and hence, the shape of the crop portions are such that the widthwise central portions of the crop portions are inwardly sunken. Additionally, the average length of crop portion of 400 mm equals about 2 percent of the plate length. Accordingly, to correct the crop, it suffices to roll and form the rolled metal upon the completion of the broadside pass in a manner that the central portion in section normal to the longitudinal direction thereof is decreased in thickness than the opposite end portions by a value of 1.7 mm corresponding to about 2 percent of the final broadside thickness as indicated by reference numeral 4 in FIG. 8 above.

Figure 11:
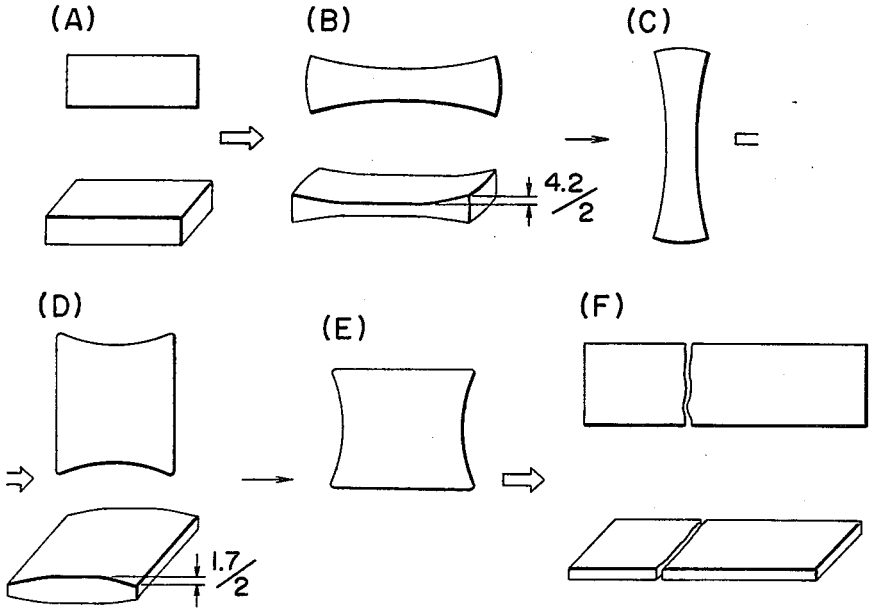
FIG. 11 is an explanatory view showing the modifications in shape of the rolled metal in the embodiment of the present invention.

Table-1 shows the pass schedule of the above embodiment and FIG. 11 illustrates the shapes at the final stages of the respective passes. Namely, it is apparent from Table-1 that the corrections in reduction are effected at the points of the pass Nos. 2 and 7. Furthermore, FIG. 11(A) shows the shape of the rolled metal before the rolling, FIG. 11(B) the shape of the rolled metal after the sizing pass, FIG. 11(C) the shape of the rolled metal when rotated through 90 in a horizontal plane after the sizing pass, FIG. 11(D) the shape of the rolled metal after the broadside pass, FIG. 11(E) the shape of the rolled metal when rotated through 90 in a horizontal plane after the broadside pass, and FIG. 11(F) the shape of the rolled metal after the rolling.

TABLE-1

| Pass No. | Plate thickness (Average) | Rolling direction | Name of pass | Corresponding FIG. No. | Remark |
|---|---|---|---|---|---|
| 1 | 200.0 | L | Sizing pass | | Corrections to rolling |
| 2 | 180.0 | L | Sizing pass | FIG. 11(B) | |
| Rotated through 90° in a horizontal plane | | | | FIG. 11(C) | |
| 3 | 160.5 | C | Broadside pass | | |
| 4 | 140.3 | C | Broadside pass | | |
| 5 | 119.5 | C | Broadside pass | | |
| 6 | 100.2 | C | Broadside pass | | Corrections to rolling |
| 7 | 85.9 | C | Broadside pass | FIG. 11(D) | |
| Rotated through 90° in a horizontal plane | | | | FIG. 11(E) | |
| 8 | 70.4 | L | Shape Control pass | | |
| 9 | 54.5 | L | Shape control pass | | |
| 10 | 40.1 | L | Shape control pass | | |
| 11 | 30.3 | L | Shape control pass | | |
| 12 | 24.6 | L | Shape control pass | | |
| 13 | 19.5 | L | Shape control pass | | |
| 14 | 17.2 | L | Shape control pass | | |
| 15 | 15.0 | L | Shape control pass | FIG. 11(F) | |

Note:
L in the column of Rolling direction indicates the longitudinal rolling of the rolled metal, and C in the same column as above indicates the cross rolling of the rolled metal.

As has been described so far, according to the present invention, the shape of the edge portions and crop portions of the rolled metal upon the completion of rolling are predicted in advance, the shape of the blank or rolled metal before the respective rolling processes are so formed that said predicted shape can be corrected, whereby the shape of the rolled metal upon the completion of the final rolling process is formed into a substantially rectangular shape, and the portions to be cut off for commercializing is decreased in number, thereby achieving an excellent advantage of considerably increasing yield.

It should be clear to one skilled in the art that if one only desires to correct the edge, one would only utilize the process described in conjunction with FIGS. 6 and 7; and that if one only desires to correct the crop, one would only utilize the process described in conjunction with FIGS. 8 and 9.

It should also be apparent to one skilled in the art that the above described embodiment is only one of the many possible embodiments that represent the applications of the principles of the present invention. Numerous and varied other arrangements could be devised by those skilled in the art without departing from the spirit and scope of the invention.

I claim:

1. A method for rolling metal plate to form a thinner plate having a desired thickness comprising the steps of:

rolling the metal plate in a longitudinal direction at a predetermined broadside ratio, said ratio being the final plate width divided by the initial plate width, to form a first metal plate having edge and crop portions;

sizing the first metal plate such that a central portion of said first plate in a section parallel to said longitudinal direction is greater in thickness than that of the end portions thereof if the edges of the first metal plate are spool shaped or sizing the first metal plate such that a central portion of the first plate in a section parallel to a longitudinal direction thereof is less in thickness than that of the end portions thereof if the edges of the first plate are barrel shaped;

rotating the sized first metal plate 90° in a horizontal plane;

rolling the first metal plate to form a second plate;

sizing the second plate such that the central portion of the second plate in a section normal to said longitudinal direction thereof is thinner than the end portions thereof if the crop portions of the second plate bulge outwardly or sizing the second plate such that the central portion of the second plate in a section normal to a longitudinal direction thereof is thicker than the end portions thereof if the crop portions of the second plate are sunken;

rotating the second metal plate 90° in a horizontal plane; and rolling the second plate.

2. The method of claim 1 wherein the edge portions are spool shaped if the broadside rolling ratio is less than a first predetermined value and said edge is barrel shaped if the broadside rolling ratio is greater than said first predetermined value and wherein the crop portions are sunken if the broadside rolling ratio is greater than a second predetermined value and the crop portions bulge outwardly if the broadside rolling ratio is less than a second predetermined value.

3. The method of claim 2 wherein the first predetermined value is 1.5 and the second predetermined value is 1.8.

4. A method for rolling metal plate comprising the steps of:

rolling the metal in a longitudinal direction at a predetermined broadside rolling ratio, said ratio being the final plate width, to form a first metal plate having edge and crop portions;

sizing the first metal plate such that a central portion of said first metal plate in a section parallel to said longitudinal direction thereof is greater in thickness than that of the end portions thereof if the edges of the first metal plate are spool shaped;

rotating the sized first metal plate 90° in a horizontal plane;

rolling the first metal plate to form a second plate;

sizing the second plate such that the central portion of the second plate in a section normal to said longitudinal direction thereof is thinner than the end portions thereof if the crop portions of the second plate bulge outwardly;

rotating the second metal plate 90° in a horizontal plane; and rolling the second plate.

5. The method of claim 4 wherein the edge portions are spool shaped if the broadside rolling ratio is less than a first predetermined value and the crop portions bulge outwardly if the broadside rolling ratio is less than a second predetermined value.

6. The method of claim 5 wherein the first predetermined value is 1.5 and the second predetermined value is 1.8.

7. A method for rolling metal plate comprising the steps of:

rolling the metal plate in a longitudinal direction at a predetermined broadside rolling ratio, said ratio being the final plate width, to form a first metal plate having edge and crop portions;

sizing the first metal plate such that a central portion of said first plate in a section parallel to said longitudinal direction thereof is less in thickness than that of the ends thereof if the edges are barrel shaped;

rotating the sized first metal plate 90° in a horizontal plane;

rolling the first metal plate to form a second plate;

sizing the second plate such that the central portion of the second plate in a section normal to said longitudinal direction is thinner than the end portions thereof if the crop portions of the second plate bulge outwardly;

rotating the second metal plate 90° in a horizontal plane; and rolling the second plate.

8. The method of claim 7 wherein the edge portions are barrel shaped if the broadside rolling ratio is greater than a first predetermined value and the crop portions bulge outwardly if the broadside rolling ratio is greater than a second predetermined value.

9. The method of claim 8 wherein the first predetermined value is 1.5 and the second predetermined value is 1.8.

10. A method for rolling metal plate comprising the steps of:

rolling the metal plate in a longitudinal direction at a predetermined broadside rolling ratio, said ratio being the final plate width, to form a first metal plate having edge and crop portions;

sizing the first metal plate such that a central portion of said first metal plate in a section parallel to said longitudinal direction is less in thickness than that of the end portions thereof if the edges are barrel shaped;

rotating the sized first metal plate 90° in a horizontal plane;

rolling the first metal plate to form a second plate;

sizing the second plate such that the central portion thereof in a section normal to said longitudinal thereof is thicker than the end portions thereof if the crop portions are sunken;

rotating the second metal plate 90° from the longitudinal direction in a horizontal plane; and rolling the second plate.

11. The method of claim 10 wherein the edge portions are barrel shaped if the broadside rolling ratio is greater than a first predetermined value and the crop portions are sunken if the broadside rolling ratio is less than a second predetermined value.

12. The method of claim 11 wherein the first predetermined value is 1.5 and the second predetermined value is 1.8.

13. A method for rolling metal plate comprising the steps of:

rolling the metal plate in a longitudinal direction at a predetermined broadside rolling ratio, said ratio being the final plate width, to form a first metal plate having edge and crop portions;

sizing the first metal plate such that a central portion of said first plate in a section parallel to said longitudinal direction is greater in thickness than that of the end portions thereof if the edges of the first plate are spool shaped;

rotating the sized first metal plate 90° in a horizontal plane; and rolling the first metal plate.

14. A method for rolling metal plate comprising the steps of:

rolling the metal plate in a longitudinal direction at a predetermined broadside rolling ratio, said ratio being the final plate width, to form a first metal plate having edge and crop portions;

sizing the first metal plate such that a central portion of said first plate in a section parallel to said longitudinal direction is less in thickness than that of the end portions thereof if the edges of the first metal plate are barrel shaped;

rotating the sized first metal plate 90° in a horizontal plane; and rolling the first metal plate.

* * * * *